US007083246B2

(12) United States Patent
Yeh et al.

(10) Patent No.: US 7,083,246 B2
(45) Date of Patent: Aug. 1, 2006

(54) ELECTRONIC TILT ADJUSTMENT IN FLUID-JET FLUID EJECTING HEADS

(75) Inventors: Andrew S. Yeh, Portland, OR (US); Christopher R. Morton, Rochester, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 264 days.

(21) Appl. No.: 10/751,399

(22) Filed: Jan. 6, 2004

(65) Prior Publication Data

US 2005/0146547 A1 Jul. 7, 2005

(51) Int. Cl.
*B41J 2/07* (2006.01)

(52) U.S. Cl. ..... 347/12
(58) Field of Classification Search ..... 347/9, 347/12, 13
See application file for complete search history.

(56) References Cited

U.S. PATENT DOCUMENTS 6,126,261 A * 10/2000 Yamanaka ..... 347/12

FOREIGN PATENT DOCUMENTS

JP 2000-263770 * 9/2000

* cited by examiner

*Primary Examiner*—Huan Tran
(74) *Attorney, Agent, or Firm*—Oliff & Berridge, PLC

(57) ABSTRACT

Systems and methods for reducing or preventing fluid misplacement by a fluid-ejecting head having a plurality of fluid ejectors are disclosed. Each of the fluid ejectors has a transducer activated in some sequence in response to input signals to eject a fluid droplet from the fluid ejector. The systems comprise electronics which integrate delay time buffers into the sequence of fluid ejector firing electronics. Adjusting the delay time buffers will adjust the angle between printed data (e.g. vertical lines) and the direction of the head motion. Several methods for determining the delay times that produce the optimal fluid placement are disclosed.

26 Claims, 5 Drawing Sheets

ELECTRONIC TILT ADJUSTMENT IN FLUID-JET FLUID EJECTING HEADS

BACKGROUND OF THE INVENTION

1. Field of Invention

This invention relates to improving print quality for fluid-jet printers.

2. Description of Related Art

In fluid jet printing, the fluid ejecting head typically includes one or more fluid ejectors. Each ejector includes a channel that communicates with a fluid supply chamber, or manifold, at one end of the fluid ejector, and with an opening at the opposite end of the fluid ejector. The opening at the opposite end of the fluid ejector is generally referred to as a nozzle. Fluid is expelled from each nozzle by known printing processes, such as "drop-on-demand" printing or continuous stream printing.

In a fluid jet printing apparatus, the fluid ejecting head typically includes one or more linear arrays of fluid ejectors. The fluid ejecting head is moved relative to the surface of the receiving medium, either by moving the receiving medium relative to a stationary fluid ejecting head, or vice versa, or both. In known fluid jet printing devices, a fluid ejecting head reciprocates across a receiving medium numerous times in the course of printing an image. Each pass of the fluid ejecting head across the receiving medium is referred to as a swath. There may be one or more fluid ejecting heads, one or more fluids ejected from each head, or some combination of both.

As the fluid ejecting head and the receiving medium are moved relative to each other, image-type digital data is used to selectively activate the fluid ejectors in the fluid ejecting head to generate a desired image.

A ubiquitous challenge in fluid-jet printing technology is the proper placement of fluid, such as, for example, ink on the receiving medium. The many manifestations of spot misplacement have many root causes. One example is the fluid ejecting head tilt error. The fluid ejecting head tilt error occurs when a line printed on the receiving medium that is intended to be perpendicular to the reciprocating motion of the head is slightly off-angle. In some cases, improper mechanical placement of the fluid ejecting head with respect to the carriage motion is responsible. Misalignment causes the defect of jagged edges in vertical lines and vertical edges, as well as other non-horizontal lines, which can span multiple swaths. While correct mechanical placement of the head is essential, there is also a more subtle cause dependent on the carriage speed, the fluid ejector firing sequence, and the time needed to step through one cycle of the firing sequence.

In modern printing devices or any other fluid jet printer which has hundreds or thousands of fluid ejectors, simultaneous operation of all nozzles requires prohibitively high currents and data rates, and would likely cause high fluidic cross-talk, degrading print quality. As a result, not all fluid ejectors are fired simultaneously. Instead, the fluid ejectors are partitioned into blocks, where each block consists of one or a small number of fluid ejectors. The fluid ejectors in a single block are fired simultaneously, and the blocks are fired sequentially. Then, for a fluid ejecting head moving left to right, the fluid fired from the fluid ejectors fired early on in a firing sequence will land on the receiving medium to the left of the fluid fired from fluid ejectors that are fired later in the firing sequence.

If the line of fluid ejectors is mechanically aligned perpendicular to the carriage direction, and if the firing sequence is such that the fluid ejectors located on the top of the fluid ejecting head are fired before the fluid ejectors situated below and printing occurs left to right, then the line of printed pixels will have a left-bent lean, as opposed to being arranged as a perfectly straight vertical line, as desired. Alternatively, when printing right to left, a vertical line tilted to the right may result. Alternatively, when printing right to left, with fluid ejectors at the bottom of the head firing before fluid ejectors situated at the top, a vertical line tilted to the left results. The magnitudes of the leans in all three examples are equal. When printing in both left to right and right to left directions, those skilled in the art will pair the left-bent leans rather than mixing left-bent and right-bent leans and introducing another defect.

A simple left-bent lean can be compensated for by design in the mechanical alignment of the head and carriage. Mechanical mechanisms, such as screws or micrometers, are known in the art to adjust the fluid ejecting head tilt. However, macroscopic mechanical tolerances are typically of the order of a 0.001 inches or 25.4 microns. This accuracy is not sufficient for the high image quality required by today's standards. The electronic system proposed in this patent has sub-micron resolution. Moreover, electronic solutions avoid mechanical hysteresis problems and are often inexpensive to implement.

Furthermore, the printer may be utilized in several print modes which require multiple carriage speeds and/or multiple times for one cycle of the firing sequence. Changing either the carriage speed or the time for one cycle of the firing sequence results in a changed tilt angle. A mechanical tilt in the design can typically compensate for only one tilt angle, not multiple tilt angles. The electronic system described in this patent permits a range of tilt angle settings for use at any time.

Other electronic means of tilt adjustment are known to those skilled in the art. For example, rotating the input image data allows one to effectively tilt the printhead by one pixel horizontally for each vertical printhead swath, or multiples thereof. The systems and methods of this invention allow a much more precise adjustment.

The problem of tilted lines occurs in all conventional print-on-demand printers, thermal ink jet printers, piezo ink jet printers, full width array printers, and any type of fluid ejecting head having multiple jets or nozzles.

SUMMARY OF THE INVENTION

Therefore, a need exists for an economical and robust printing apparatus and method whereby fluid misplacement and misalignment issues may be corrected or compensated for a plurality of different fluid ejecting heads and of print modes to improve print quality.

This invention provides systems and methods for improving print quality for fluid jet printers by modifying the timing and/or firing sequence of one or more fluid ejectors on a fluid ejecting head.

This invention provides systems and methods for adjusting the tilt of a nominally vertical line of pixels printed by a fluid ejecting head.

This invention provides systems and methods for electronically changing the tilt of any fluid ejecting head. In various exemplary embodiments, the tilt adjustment is accomplished by measuring the current tilt of a particular fluid ejecting head, and by electronically compensating for the tilt. Tilt adjustment only has to be performed once in each print mode for each fluid ejecting head. Multiple tilt correction factors for each printhead can be determined and used as necessary.

This invention additionally provides systems and methods for variable compensation of mechanical tilt misalignment of a fluid ejecting head having a plurality of fluid ejectors. In various exemplary embodiments, the composition is achieved by incorporating switchable "dummy spacer" circuit elements into the fluid ejecting head firing sequence to control the amount of delay before one or more of the fluid ejectors are fired.

In various exemplary embodiments, systems and methods of this invention provide for dummy spacer circuit elements which determine whether an enable wave train is delayed by a particular variable length dummy spacer, or whether the enable wave train avoids a particular dummy spacer time delay and instead continues to next sequential block of fluid ejectors to be fired.

In various exemplary embodiments, systems and methods of this invention provide for dividing the fluid ejectors of a fluid ejecting head into one or more blocks or groups of one or more fluid ejectors each, inserting dummy spacer time delays of variable length between blocks of fluid ejectors, and generating a firing sequence for the fluid ejecting heads which marches through the dummy spacer time delays and blocks of fluid ejectors in sequence.

In various exemplary embodiments, systems and methods of this invention provide for adjusting the tilt of a fluid ejecting head by up to an arbitrary amount. In practice, this system could be used in conjunction with other means of tilt adjustment. For example, electronic image rotation has a resolution of about one or two pixels horizontally for every swath vertically, and this system has a sub-pixel resolution, which depends on system parameters such as the single jetting frequency and the bitshift rate, but can typically be as low as 0.001 pixels. A pixel refers to the fluid drop placement on a receiving medium resulting from the fastest firing of a single fluid ejector.

BRIEF DESCRIPTION OF THE DRAWINGS

Various exemplary embodiments of this invention will be described in detail, with reference to the following figures, wherein.

DETAILED DESCRIPTION OF EXEMPLARY EMBODIMENTS

Figure 1:
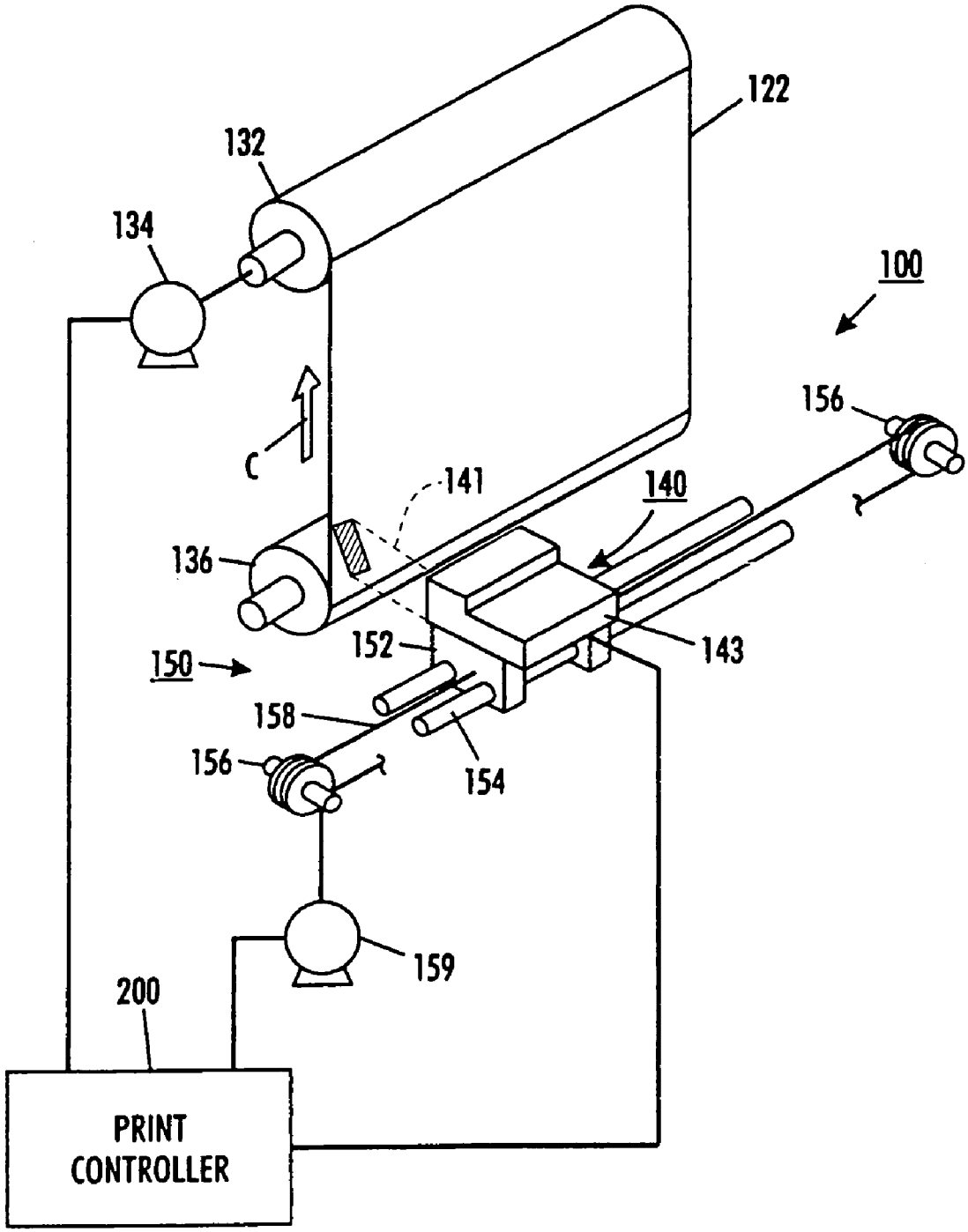
FIG. 1 is a schematic view of an exemplary embodiment of a printing system usable with the systems and methods according to this invention.

For simplicity and clarification, the operating principles and design factors of various exemplary embodiments of the systems and methods according to this invention are explained with reference to one exemplary embodiment of a carriage-type fluid jet printer 100, as shown in FIG. 1, and one exemplary embodiment of a fluid ejecting head 140. The basic explanation of the operation of the fluid jet printer 100 and the fluid ejecting head 140 is applicable for the understanding and design of any fluid ejection system that incorporates this invention. Although the systems and methods of this invention are described in conjunction with the fluid jet printer 100 and the fluid ejecting head 140, the systems and methods of this invention can be used with any other known or later-developed fluid ejection system.

FIG. 1 is a schematic view of an exemplary embodiment of a printing system usable with the systems and methods according to this invention. As shown in FIG. 1, a carriage-type fluid jet printer 100 has a linear array of droplet-producing channels housed in fluid ejecting head 140 mounted on a reciprocal carriage assembly 143. The array extends along a process direction C. The fluid ejecting head 140 includes one or more arrays of ink or fluid ejecting channels and corresponding nozzles or fluid ejectors. Fluid droplets 141 are propelled onto a receiving medium 122, such as a sheet of paper, that is stepped a predetermined distance by a motor 134 in the process direction C each time the fluid ejecting head 140 traverses across the receiving medium 122 along a swath axis, or fast scan direction, D. This predetermined distance is usually less than or equal to the size of the array, depending on the design of the fluid ejecting head 140 and the image being printed. The receiving medium 122 can be either cut sheets or a continuous sheet. If the receiving medium 122 is a continuous sheet, it can be stored on a supply roll 136 and stepped onto take-up roll 132 by the stepper motor 134. Alternatively, the receiving medium 122 can be stored in and/or advanced using any other known or later-developed structures, apparatuses or devices.

The fluid ejecting head 140 is mounted on a support base 152, which reciprocally moves along the swath axis D using any known or later-developed apparatus or device, such as two parallel guide rails 154. A cable 158 and a pair of pulleys 156 can be used to reciprocally move the fluid ejecting head 140 along the guide rails 154. One of the pulleys 156 can be powered by a reversible motor 159.

The fluid ejecting head 140 is generally moved across the receiving medium 122 perpendicularly to the direction the receiving medium 122 is moved by the motor 134. Of course, other structures for moving the carriage assembly 143 relative to the receiving medium 122 can be used without departing from the spirit and scope of this invention. For example, according to various exemplary embodiments, the receiving medium may be stationary, while a fluid ejecting head moves horizontally or vertically across the receiving medium. Moreover, the fluid ejectors in the fluid ejecting head may be lined up either vertically, horizontally, or both.

According to various other exemplary embodiments, the systems and methods of the present invention advantageously support a stationary fluid ejecting head and a moving receiving medium.

The fluid jet printer 100 is controlled by a print controller 200. The print controller 200 transmits commands to the motors 134 and 159 and to the fluid ejecting head 140 to produce a pattern of ejected fluid drops on the receiving medium 122. In particular, for an fluid jet printer, this pattern forms an image on an image receiving medium 122.

Figure 2:
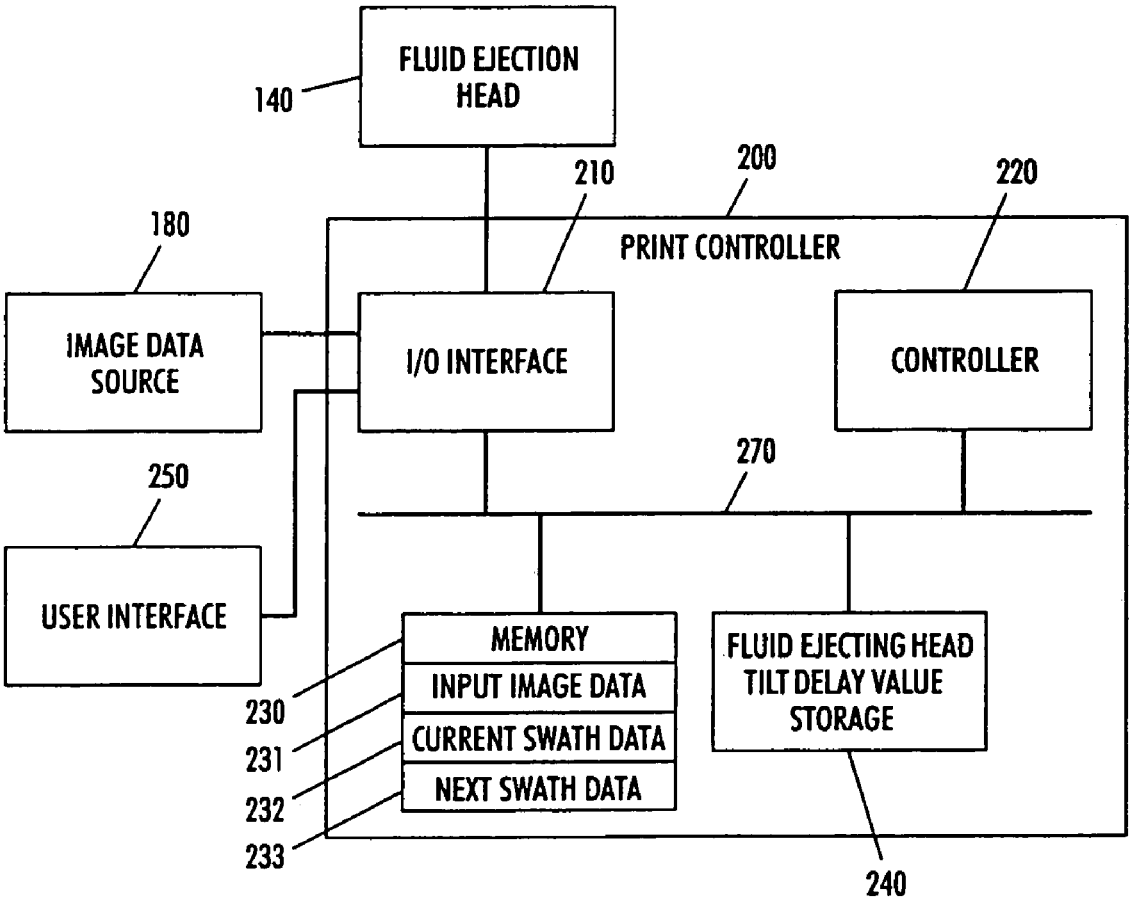
FIG. 2 is a block diagram of an exemplary embodiment of a print controller used in accordance with the printing system of FIG. 1.

FIG. 2 is a block diagram of an exemplary embodiment of a print controller used in accordance with the printing system of FIG. 1. In FIG. 2, the print controller 200 is connected to an image data source 180 and the fluid ejecting head 140. The image data source 180 can be any known or later-developed source of image data to be used in the printing system in accordance with this invention. The print controller 200 can include an input/output interface 210, a controller 220, a memory 230, and a fluid ejecting head tilt delay value storage area 240. The printer controller components 210–240 are interconnected and controlled by the controller 220 through a busline 270.

The input/output interface 210 allows the print controller 200 to receive the image data from the image data source 180 and process the image data in accordance with the printing systems and methods of this invention in order to eject fluid through the fluid ejecting head 140. The memory 230 stores image data for ejecting fluid onto the receiving medium. The memory 230 can include one or more of an input interface section 231, a current swath data section 232, and a next swath data section 233. The input interface section 231 stores image data input from the image data source 180. The current swath data section 232 stores current data related to, for example, the creation of a first print swath and/or a second print swath that will be printed by the fluid ejecting head 140. The next swath data 233 of the memory 230 stores the next print swath that will be printed by the fluid ejecting head 140.

User interface 250 is used to add, modify, or delete the fluid ejecting head tilt delay values in fluid ejecting head tilt delay value storage 240 using, for example, a print driver user interface to add, modify, replace, or delete the delay values.

Figure 3:
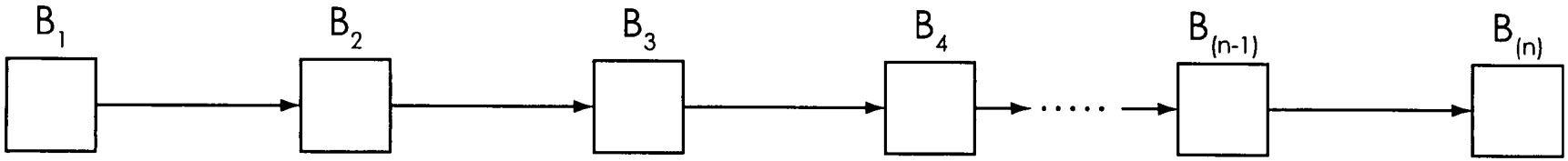
FIG. 3 RELATED ART
FIG. 3 shows a conventional firing sequence of blocks of fluid ejectors in a fluid-ejecting fluid ejecting head.

FIG. 3 shows a related art firing sequence of blocks of fluid ejectors in a fluid-ejecting fluid ejecting head. A plurality of nozzles or fluid ejectors in a fluid-ejecting head are divided into n blocks of one or more fluid ejectors each, labeled as $B_1$ to $B_{(n)}$ in FIG. 3. An enable wave train progresses or marches through then blocks in a predetermined sequential order: $B_1, B_2, B_3 \ldots B_{(n-1)}, B_{(n)}$, until all of the blocks of nozzles have had the opportunity to fire. For this discussion, a bitshift is a unit of time, equal to the shortest time difference permitted by the electronics between the firing times of two non-simultaneous fluid ejectors. Then, one block $B_{(i)}$, where i=1 to n, is fired or has the opportunity to fire per bitshift. According to various exemplary embodiments, one bitshift is typically equal to about 100 of nanoseconds. n bitshifts are needed to step through one cycle of all the fluid ejectors.

Figure 4:
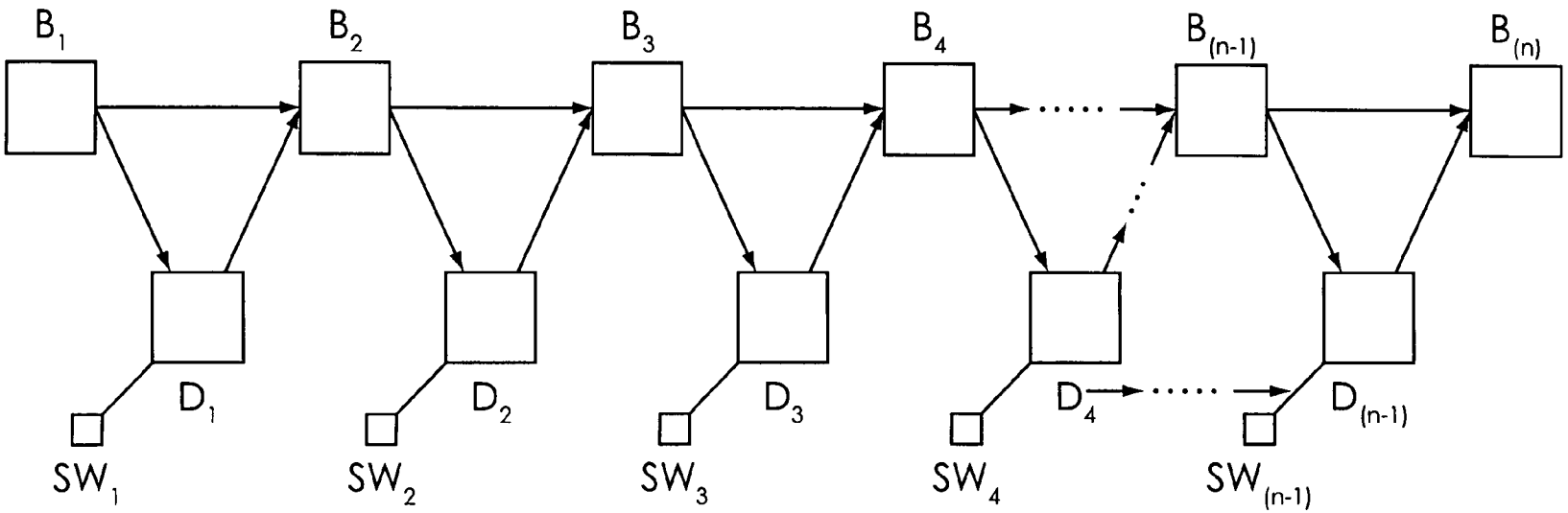
FIG. 4 shows a firing sequence of blocks of fluid ejectors with dummy spacer time delays according to this invention.

FIG. 4 shows a firing sequence of blocks of fluid ejectors with dummy spacer time delays according to various exemplary embodiments of this invention. Blocks of fluid ejectors $B_1$ to $B_{(n)}$ are shown in FIG. 4, where n equals the total number of blocks of fluid ejectors. As shown in FIG. 4, dummy spacers $D_1$ to $D_{(n-1)}$ are placed between each pair of adjacent blocks $B_{(j)}$ and $B_{(j+1)}$, where j=1 to n−1, to add timing delays between the firings of blocks of fluid ejectors $B_{(i)}$. Such timing delays allow for a fine tuning of the tilt of fluid ejector head 140.

A switch $SW_{(j)}$ on each dummy spacer determines whether an initiated enable wave train coming from previous block $B_{(j)}$ passes through the associated dummy spacer $D_{(j)}$ thereby creating a time delay, or continues without delay directly to next block $B_{(j+1)}$.

The timings for the dummy spacers, $D_1$ to $D_{(n-1)}$, are variable. Each dummy spacer $D_{(j)}$ does not have to have the same delay time, and in fact, all $D_{(j)}$ may contain different time values, or a combination of similar and dissimilar time values.

In various exemplary embodiments, the time needed to fire all of the blocks of fluid ejectors ranges from n bitshifts for an exemplary embodiment in which all $D_{(j)}$ are switched off up to ((2*n)−1) bitshifts for an exemplary embodiment in which all D(j) are switched on and equal to one bitshift of delay.

Advantageously, dummy spacers $D_{(j)}$ allow a fine tuning of the time needed to step through one cycle of all the fluid ejectors. Since either or both of the fluid ejecting head carriage and the receiving medium moves as the fluid ejectors are firing, turning the time needed to step through one cycle of all the fluid ejectors advantageously results in a corresponding tuning of the tilt of a printed nominally vertical line.

According to various exemplary embodiments, there may be more than one dummy spacer per switch. Thus, for example, multiple dummy spacers may be grouped into a single subset controlled by a single switch. For example, with five switches, and where the total number of blocks equals n=26, for example, the dummy groups could be grouped into five subsets: $\{D_1, D_6, D_{11}, D_{16}, D_{21}\}$, $\{D_2, D_7, D_{12}, D_{17}, D_{22}\}$, $\{D_3, D_8, D_{13}, D_{18}, D_{23}\}$, $\{D_4, D_9, D_{14}, D_{19}, D_{24}\}$, and $\{D_5, D_{10}, D_{15}, D_{20}, D_{25}\}$. With such a grouping of dummy spacers, each switch of the five switches has control over one of five subsets. If the delay time for each dummy spacer is set to 1 bitshift, the time needed for one firing of all the fluid ejectors will be n+0, n+5, n+10, n+15, n+20, and n+25 bitshifts, depending on whether 0, 1, 2, 3, 4, or 5 switches, respectively, are activated. Advantageously, six levels of equally or nearly equally spaced tilt control thereby result.

Since the delay times are always greater or equal to zero, the tilt adjustment is in one direction only. In order to utilize this invention with the maximum effectiveness, one may intentionally mechanically place the head in the carriage so that the nominal head needs, for example, 15 bitshifts of tilt adjustment. Then, there is latitude to shift the head in both directions by adjusting the delay times.

Typically, different print modes with different carriage speeds and/or different numbers of firing jets require different tilt corrections for a particular fluid ejecting head. Advantageously, the plurality of levels of programmable tilt adjustment possible with this invention provide an expedient and cost effective solution for adjusting the tilt of a fluid ejecting head.

Additionally, each fluid ejection head inserted into a fluid ejecting apparatus may be independently adjusted for tilt correction based on the specifications of a particular fluid ejecting head, the characteristics of a particular print mode, and/or a particular carriage speed.

According various other exemplary embodiments, the fluid ejectors in a block $B_{(i)}$ of fluid ejectors need not be sequentially arranged in fluid ejecting head. For example, any $B_{(i)}$ may include every second, or third, or fourth, etc., of sequentially arranged fluid ejectors physically located in fluid ejecting head. Alternately, a particular $B_{(i)}$ may include the first fluid ejector and the last fluid ejector in fluid ejecting head 140. Thus, the blocks of fluid ejectors may include any number or arrangement of fluid ejectors.

Referring to FIGS. 1 and 2, communication between the print driver 250 and fluid jet printer 100 may be implemented via print controller 200. The print driver 250 communicates with, and instructs, storage 240 to store the delay settings $D_1$ to $D_{(n-1)}$ which produce the optimum swath data for each fluid ejection head and print mode. Upon fluid ejection head 140 head power-up or change in print mode, the fluid ejection head 140 would be programmed to use the delay values stored in storage 240.

Alternately, the dummy spacer delay times may be stored in a computer, and upon boot-up, the dummy spacer times would be transferred to the fluid jet printer 100 using, for example, a data cable or a wireless transfer device, which are both well known in the art.

In another embodiment, the dummy spacer delay settings $D_1$ to $D_{(n-1)}$ may be stored in storage 240. An advantage to this embodiment is if the fluid jet 100 is moved and used with another computer, then the dummy spacer delay settings $D_1$ to $D_{(n-1)}$ times are not lost.

Once the printing apparatus determines which delay times to use, the printing apparatus programs these delay times into the fluid ejecting head 140. Delay times may be stored in the firmware and then loaded into the head upon demand.

According to various exemplary embodiments, dummy spacers $D_{(j)}$ may be implemented by, for example, electronics in fluid ejecting head 140.

Figure 5:
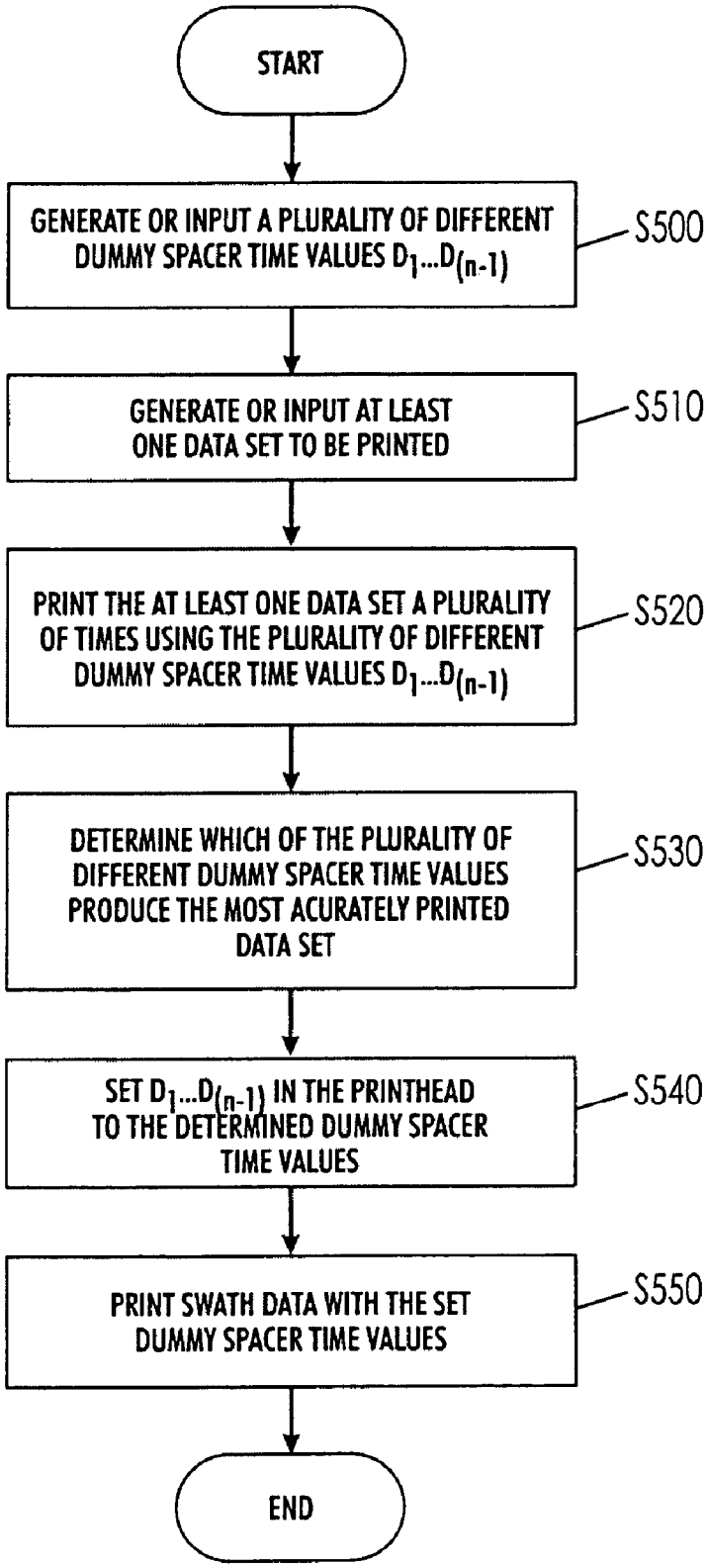
FIG. 5 is a flowchart outlining an exemplary embodiment of a method for electronically adjusting the tilt of a fluid ejecting level according to this invention.

FIG. 5 is a flowchart outlining an exemplary embodiment of a method for improving print quality according to this invention. As shown in FIG. 5, the method begins at step S500, where a plurality of different sets of dummy spacer time values $D_1 \ldots D_{(n-1)}$ are generated via a computer algorithm or instruction, inputted into a computer or both. The dummy spacer time values may be stored in, for example, a dummy spacer time matrix, wherein the first row of the matrix corresponds to the first set of $D_1 \ldots D_{(n-1)}$, the second row of the matrix corresponds to the second set of $D_1 \ldots D_{(n-1)} \ldots$ and the (n−1) row corresponds to the (n−1) set of $D_1 \ldots D_{(n-1)}$.

In various exemplary embodiments, the first row of the matrix may have all dummy spacers equal to zero seconds, i.e., no time delay. The second row have, for example, $D_1$ equal to 1 bitshift, and $D_2 \ldots D_{(n-1)}$ all equal to zero bitshifts. The third row may have, for example, $D_1=D_2=1$ bitshifts, and $D_3 \ldots D_{(n-1)}$ all equal to zero bitshifts. Further rows may be similarly generated or inputted for any of the possible timing possibilities. It should be appreciated that all of $D_1 \ldots D_{(n-1)}$ may be assigned similar or distinct time delays of any value, with no limitations imposed thereon.

Next in step S510, at least one data set is generated or inputted. The at least one data set may include, for example, images, text, pixel data, full pixel swath data, and/or, according to various exemplary embodiments, nominally vertical line data. The method then proceeds to step S520, where the at least one data set is printed a plurality of different times—with each printing using a different row of dummy spacer time values $D_1 \ldots D_{(n-1)}$ from the matrix generated or input at step S500. Thus, according to various exemplary embodiments, the number of printings of the at least one data set is equal to the number of plurality of different dummy spacer time values $D_1 \ldots D_{(n-1)}$, although it should be appreciated that more or less printings may be alternatively be utilized effectively.

Once the data set(s) are printed, the method continues to step S530, where a determination is made as to which of the plurality of different dummy spacer time values produce the most accurately printed data set. Hence, step S530 identifies the printed data set and associated dummy spacer time values with the least amount (if any) of fluid-spot misplacement. In various exemplary embodiments, this determination may be made by a determination unit which scans and digitizes the printed data sets and determines, based on the angle of the printed vertical lines, for example, which printed data set and associated dummy spacer time values produces the most accurately printed vertical lines, i.e., those vertical lines which are closest to being printed 90 degrees from the horizontal axis.

According to various alternative exemplary embodiments, optimum dummy spacer time values are determined by printing out multiple full-pixel swaths at step S520 using the plurality of dummy spacer time values, and scanning in each full-pixel swath and detecting with the determining unit at step S530, which dummy spacer time values produce a full-pixel swath which is closest to a perfect rectangle.

According to various other exemplary embodiments, the optimum dummy spacer time values at step S530 may be determined by printing out an alignment page using the plurality of dummy spacer time values (at step S520) visually examining the alignment page, and then selecting the settings corresponding to the lines which look the most vertical.

From step S530, processing proceeds to step S540, wherein the determined optimal dummy spacer time values are downloaded into fluid ejecting head, so that at step S550, future printings of swath data using the determined optimal dummy spacer time values may be as accurate to the representative pixels in the swath data as possible.

In another embodiment of the method, a single data set is printed. The determination unit scans the printed data set, measures the angles of the lines or data therein, and calculates the optimal dummy spacer time values. The optimal dummy spacer time values are then stored or transferred into the fluid ejecting head.

In another embodiment of the method, an optical, electronic, or mechanical measurement system is utilized to measure the physical positions of two or more fluid ejectors. The tilt of the fluid ejector head can then be calculated, and the optimal dummy spacer time values determined. This measurement system can be contained within or be independent of the fluid jet printer.

In another embodiment of the method, an optical, electronic, or mechanical drop detection device is utilized to measure the position of the ejected fluid from two or more fluid ejectors. The tilt of the fluid ejector head can then be calculated, and the optimal dummy spacer time values determined. This measurement system can be contained within or be independent of the fluid jet printer.

Any of the methods described above may be repeated for each printhead and/or each print mode in order to determine the optimal adjustment factors for each printhead and/or each print mode.

While this invention has been described in conjunction with the specific exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A recording medium on which is recorded a control program for a data processor that reduces or prevents fluid misplacement by a fluid-ejecting head having a plurality of fluid ejectors, the recording medium including instructions for causing the data processor to:

determine delay times between firings of the plurality of fluid ejectors that produce the least amount of ejected fluid misplacement.

2. The recording medium of claim 1, further including instructions for causing the data processor to:

measure the physical positions of two or more fluid ejectors; and calculate the tilt of the fluid-ejecting head.

3. The recording medium of claim 1, further including instructions for causing the data processor to:

measure the position of ejected fluid from two or more fluid ejectors.

4. The recording medium of claim 1, further including instructions for causing the data processor to:

set delay times between the plurality of fluid-ejectors to the determined delay times.

5. The recording medium according to claim 4, further including instructions for causing the data processor to:

print swath data using the set delay times.

6. The recording medium according to claim 1, further including instructions for causing the data processor to:

print a plurality of data sets comprising pixel data using different delay times between the firings of the plurality of fluid ejectors for each printed data set.

7. The recording medium according to claim 6, wherein the pixel data comprises images and/or text.

8. The recording medium according to claim 6, wherein the pixel data comprises vertical lines.

9. The recording medium of claim 8, further including instructions for causing the data processor to:

measure tilt of the printed vertical lines produced by each printed data set; and identify the delay times producing the least measurable amount of tilt.

10. The recording medium of claim 1, further including instructions for causing the data processor to:

print a single data set;

scan the printed data set; and measure angles within the printed data set.

11. The recording medium of claim 6, wherein the plurality of data sets are printed on a receiving medium.

12. The recording medium of claim 11, wherein the receiving medium is paper.

13. The recording medium according to claim 1, wherein the fluid ejectors are ink-jet ejectors.

14. The recording medium according to claim 6, wherein each of the plurality of data sets are identical.

15. A fluid ejection system that ejects fluids onto a receiving medium, comprising:

one or more fluid ejecting heads having a plurality of fluid ejectors that eject fluid;

an electronics system having fluid ejector firing electronics and at least one delay time buffer; and a determining unit that determines delay times that produce the least amount of ejected fluid misplacement.

16. The fluid ejection system of claim 15, wherein the at least one delay time buffer allows for independent, variable delay of the plurality of fluid ejectors.

17. The fluid ejection system of claim 15, wherein the at least one delay time buffer allows for a fixed delay of the plurality of fluid ejectors.

18. The fluid ejection system of claim 15, wherein the delay times are determined for each fluid ejecting head and/or different print modes.

19. The fluid ejection system of claim 15, further comprising:

a setting unit configured to set delay times between the firings of the plurality of fluid ejectors to the delay times determined by the determining unit.

20. The fluid ejection system of claim 19, further comprising:

a printing unit configured to print swath data using the set delay times.

21. The fluid ejection system of claim 15, further comprising:

a receiver that receives a plurality of data sets that comprise pixel data.

22. The fluid ejection system of claim 21, wherein the pixel data comprises images and/or text.

23. The fluid ejection system claim 21, wherein the pixel data comprises nominally vertical lines.

24. The fluid ejection system of claim 21, further comprising:

a measurement unit that measures the tilt of printed vertical lines produced by printed data sets; and an identifying unit that identifies the delay times producing the least measurable amount of tilt.

25. The fluid ejection system of claim 15, wherein the fluid is ink.

26. The fluid ejection system of claim 15, wherein the receiving medium is paper.

* * * * *